US007095373B2

(12) United States Patent
Aikawa et al.

(10) Patent No.: US 7,095,373 B2
(45) Date of Patent: Aug. 22, 2006

(54) PLANAR ARRAY ANTENNA

(75) Inventors: Masayoshi Aikawa, Saga (JP); Eisuke Nishiyama, Saga (JP); Fumio Asamura, Saitama (JP); Takeo Oita, Saitama (JP)

(73) Assignees: Saga University, Saga (JP); Nihon Dempa Kogyo Co., Ltd., Tokyo (JP)

( * ) Notice: Subject to any disclaimer, the term of this patent is extended or adjusted under 35 U.S.C. 154(b) by 0 days.

(21) Appl. No.: 11/137,107

(22) Filed: May 25, 2005

(65) Prior Publication Data

US 2005/0264451 A1 Dec. 1, 2005

(30) Foreign Application Priority Data

May 25, 2004 (JP) ..... 2004-155215

(51) Int. Cl.
*H01Q 1/38* (2006.01)

(52) U.S. Cl. ..... 343/700 MS

(58) Field of Classification Search ..... 343/700 MS, 343/846, 770, 853

See application file for complete search history.

(56) References Cited

U.S. PATENT DOCUMENTS

| | | | | |
|---|---|---|---|---|
| 5,241,321 | A * | 8/1993 | Tsao | 343/700 MS |
| 6,239,762 | B1 * | 5/2001 | Lier | 343/770 |
| 6,288,679 | B1 * | 9/2001 | Fischer et al. | 343/700 MS |
| 6,753,817 | B1 | 6/2004 | Aikawa et al. | |

* cited by examiner

*Primary Examiner*—Tho Phan
(74) *Attorney, Agent, or Firm*—Katten Muchin Rosenman LLP

(57) ABSTRACT

A planar array antenna using a multi-layer substrate having an intermediate layer conductor in a laminated face comprises: four pieces of planar antenna elements disposed at each of geometrically square shaped apexes; first and second slot lines formed in the intermediate layer conductor, and intersecting each other; first to fourth microstrip lines formed along each side of geometrical squares so as to be coupled to each antenna element, and at the same time, electromagnetically coupled to first and second slot lines at both ends of these slot lines; and fifth and sixth microstrip lines, the top end sides thereof traversing the first and second slot lines, respectively, so as to be electromagnetically coupled to the first and second slot lines.

15 Claims, 9 Drawing Sheets

PLANAR ARRAY ANTENNA

BACKGROUND OF THE INVENTION

1. Field of the Invention

The present invention relates to an array antenna which is used in a frequency band such as a millimeter band, a microwave band, and the like, and uses a planar resonator, and more particularly, to a planar array antenna, which can easily perform transmission and reception of an orthogonal polarization and a circular polarization, and can easily perform transmission and reception at plural frequency bands.

2. Description of the Background Arts

In general, a planar antenna can be easily fabricated and processed, and made compact and light in weight. Hence, It finds wide use in the field of radio communications, satellite broadcasts, and the like. Accompanied by development and diversification of the radio communications in recent years, the planar antenna has been also expected to have high performance and sophisticated features. In U.S. Pat. No. 6,753,817, the present inventors have proposed a multi-element planar antenna, which can share polarization components, and can use a circular polarization.

FIGS. 1A and 1B illustrate a conventional multi-element planar antenna. This planar antenna comprises four antenna elements 2*a* to 2*d* formed on substrate 1 made from dielectric materials and the like, and a feeding system for these antenna elements. Each of antenna elements 2*a* to 2*d* is configured as a planar resonator of a microstrip line type, and is specifically comprised of square resonance conductor 3 provided on one principal surface of substrate 1, and ground conductor 4 formed on an almost entire surface of the other principal surface of substrate 1. The centers of antenna elements 2*a* to 2*d* are positioned at each apex of a geometrical square, in the example shown here, a regular square.

The feeding system comprises first to fourth microstrip lines 5, 6, 7 and 8 provided on one principal surface of substrate 1, and first and second slot lines 9 and 10 provided on the other principal surface. First and second slot lines 9 and 10 are formed as slot lines having the same length and being short-circuited at both ends, and extend in mutually orthogonal directions, and at the same time, mutually intersect at the median point thereof. This intersection is equal to the center of the geometrical square. In the figure, first slot line 9 extends in the vertical direction, and second slot line 10 extends in the horizontal direction. That is, slot lines 9 and 10 are formed in the shape of a cross as a whole. As will be described later, four corners formed at a position where slot lines 9 and 10 intersect each other in ground conductor 4 becomes feeding positions for this planar antenna.

Any of microstrip lines 5 to 8 is the same in length, and as a whole, is formed along the side of the regular square. Antenna element 2*a* at the left above in the figure is connected to the upper end of microstrip line 7 and the left end of microstrip line 5, and is fed at two points from these microstrip lines 7 and 5. Similarly, antenna element 2*b* at the right above in the figure is connected to the upper end of microstrip line 8 and the right end of microstrip line 5, and antenna element 2*d* at the left below in the figure is connected to the left end of microstrip line 6 and the lower end of microstrip 7, and antenna element 2*c* at the right below in the figure is connected to the right end of microstrip line 6 and to the lower end of microstrip line 8. These microstrip lines 5 to 8 are orthogonal to these slot lines 9 and 10 so as to traverse them, respectively, at equally distant positions in the vertical and horizontal directions from the intersection of slot lines 9 and 10, and are electromagnetically coupled to these slot lines. With the guide wavelength corresponding to the antenna design frequency of this planar antenna taken as λ, the top end of each of slot lines 9 and 10 becomes a short-circuit end edge, but it is preferable that the top end is allowed to extend approximately λ/4 in length from the traversing point with the microstrip line. If configured in this manner, in the antenna design frequency, the top end of each of slot lines 9 and 10 electrically functions as an open end seen from the traversing point with the microstrip lines, and in this manner, propagation efficiency from the feeding point to the antenna element through slot lines and microstrip lines is enhanced.

In this planar antenna, each of antenna elements 2*a* to 2*d* has a degenerate mode in horizontal and vertical orthogonal directions. The electrical length from the intersection of first and second slot lines 9 and 10 to each of antenna elements 2*a* to 2*d* through microstrip lines 5 to 8 is the same.

As described above, in this planar antenna, four corners in ground conductor 4 formed at the position where first and second slot lines 9 and 10 intersect each other become feeding positions fed with high frequency signals. Hence, for the sake of simplicity, these four corners will be referred to as a, b, c, and d clockwise from the left above in the figure.

First, among the four corners in the feeding position, corners a and b located at the upper side of second slot line 10 are made a pair, and corners c and d located at the lower side of second slot line 10 are made another pair, and between corners a and b, and corners c and d, high frequency signals are fed. As a result, in second slot line 10 extending in the horizontal direction, a high frequency component is excited in the electric field direction shown by an arrow. This high frequency component is propagated to both ends of second slot line 10, and electromagnetically couples with the microstrip lines at each median point of third and fourth microstrip lines 7 and 8. Since the conversion from a slot line to a microstrip line is a reverse-phase series branch, the high frequency propagated to microstrip lines 7 and 8 is reversed in electrical field, respectively in the vertical direction in the figure, and is propagated in a reverse phase. While, seen from second slot line 10, antenna elements 2*a* and 2*b* at the upper side in the figure and antenna elements 2*c* and 2*d* at the lower side in figure are fed with high frequency signals in reverse phase, since the feeding points of the antenna elements are in mirror symmetry, each antenna is excited in-phase. In this case, since the feeding in the vertical direction is made to each of antenna elements 2*a* to 2*d*, a vertical polarization is radiated.

Among four corners a, b, c, and d in the intersection of slot lines 9 and 10, if corners a and d located at the left side of first slot line 9 are made a pair, and corners b and c located at the right side of second slot line 9 are also made a pair, and the feeding is made between corners a and d and corners b and c, a high frequency component is excited in first slot line 9 extending in the vertical direction. This high frequency component is propagated from the median points of first and second microstrip lines 5 and 6 to both end sides of these microstrip lines by electromagnetic coupling. At this time, in each of microstrip lines, when seen from the median points thereof, the electric field is reversed, and the high frequency component is distributed in reverse phase in the horizontal direction. As a result, similarly to the aforementioned case, in each of antenna elements 2*a* to 2*d*, high frequency is fed in-phase in the horizontal direction, and is radiated as a horizontal polarization from these antenna elements. Here, since the shape of the antenna element is made regular square, the antenna frequency by means of the vertical polarization and the antenna frequency by means of the horizontal polarization correspond to each other.

In the planar array antenna shown in FIGS. 1A and 1B, a functional device such as an integrated circuit (IC) and the like is connected to the vicinity of the intersection of first and second slot lines 9 and 10, and if the space between the corners located in the vertical direction or the space between the corners located in the horizontal direction are selected and fed, in other words, if the space between corners a and b, and corners c and d, or the space between corners a and d, and other corners are selected and fed, the vertical polarization or the horizontal polarization can be switchably transmitted by a single array antenna.

Further, according to this planar array antenna, through the feeding between the corners located in a diagonal direction, that is, through the feeding either between corners a and c or between corners b and d, a linear polarization can be transmitted in a direction to tilt 45 degrees in the upper or lower direction, respectively, from the horizontal direction in the figure. Further, through the provision of a delay circuit, it is possible to transmit the circular polarization, and through the change of the shape of each antenna element, a planar array antenna sharing plural antenna frequencies can be configured. It is apparent that, in consideration of reversibility in the antenna, receiving operation is possible also by the reverse action of transmitting operation.

However, in the planar array antenna thus configured, a functional device for feeding is connected to the intersection between first and second slot lines, and for example, a feeding cable is connected so as to extend in the vertical direction to the substrate surface. Hence, the antenna including the feeding cable becomes three-dimensional, and surfaceness or compactness of the antenna is prevented.

Hence, in the above described U.S. Pat. No. 6,753,817, the present inventors have proposed a structure in which a dielectric substrate is also disposed on ground conductor 4 in the planar array antenna shown in FIGS. 1A and 1B, and make the antenna into a multi-layer substrate structure, and on the surface of that dielectric substrate, a feeding microstrip line is disposed. Here, ground conductor 4, which becomes an intermediate layer conductor of the multi-layer substrate, is formed with first and second slot lines, and the feeding microstrip line on the dielectric substrate extends till a position corresponding to the intersection of first and second slot lines, and feed these first and second slot lines. Here, through extending the feeding microstrip line in the diagonal direction in the intersection, for example, in the direction to connect corner b and corner d, it is possible to transmit the linear polarization in a direction to tilt 45 degrees to the right from the vertical direction. Through the change of the arrangement of the feeding microstrip lines, the vertical polarization and the horizontal polarization can be transmitted and received.

However, to make such a planar array antenna shareable with the vertical polarization and the horizontal polarization, the feeding microstrip lines must intersect each other on the dielectric substrate. Further, while it is conceivable to provide feeding microstrip lines for first and second slot lines on the principal surface side on which the antenna elements are provided, such feeding microstrip lines intersect any of the first to fourth microstrip lines 5 to 8 which connect between antenna elements 2*a* to 2*d*.

Eventually, in the case of the planar array antenna shown in FIGS. 1A and 1B, it is difficult to constitute a feeding system by the microstrip lines, while sharing the vertical polarization and the horizontal polarization, and therefore, it is difficult to construct the antenna including the feeding system in a planar manner.

SUMMARY OF THE INVENTION

An object of the present invention is to provide a planar array antenna, which is sharable with a vertical polarization and a horizontal polarization, simplified in wiring of a feeding system, and easy for achieving planar configuration of an antenna including the feeding system.

An object of the present invention can be achieved by a planar array antenna, comprising: a multi-layer substrate having an intermediate layer conductor in a laminated face; first and second slot lines formed in the intermediate layer conductor, and intersecting each other; first and second microstrip lines formed on the multi-layer substrate, and traversing the first slot line, respectively, at a position corresponding to both end sides of the first slot line; third and fourth microstrip lines formed on the multi-layer substrate, and traversing the second slot line, respectively, at a position corresponding to both end sides of the second slot line; a first antenna element coupling to one end of the first microstrip line and one end of the third microstrip line; a second antenna element coupling to the other end of the first microstrip line and one end of the fourth microstrip line; a third antenna element coupling to one end of the second microstrip line and the other end of the fourth microstrip line; a fourth antenna element coupling to the other end of the second microstrip line and the other end of the third microstrip line; a fifth microstrip line provided on the multi-layer substrate, the top end side of the fifth microstrip line traversing the first slot line in the center region of the first slot line so as to be electromagnetically coupled to the first slot line; and a sixth microstrip line provided on the multi-layer substrate, the top end side of sixth microstrip line traversing the second slot line in a center region of the second slot line so as to be electromagnetically coupled to the second slot line, wherein each antenna element is an antenna element excitable in two directions.

According to the above described configuration, since the feeding is made to the first and second slot lines by the fifth and sixth microstrip lines, the feeding system can be configured by transmission lines only, and there is no need for the functional device for sharing the vertical polarization and the horizontal polarization similarly to the conventional example. In this manner, there is no feeding cable provided in the vertical direction for a board surface, and therefore, surfaceness of the antenna can be promoted.

DETAILED DESCRIPTION OF THE PREFERRED EMBODIMENTS

Figure 1A:
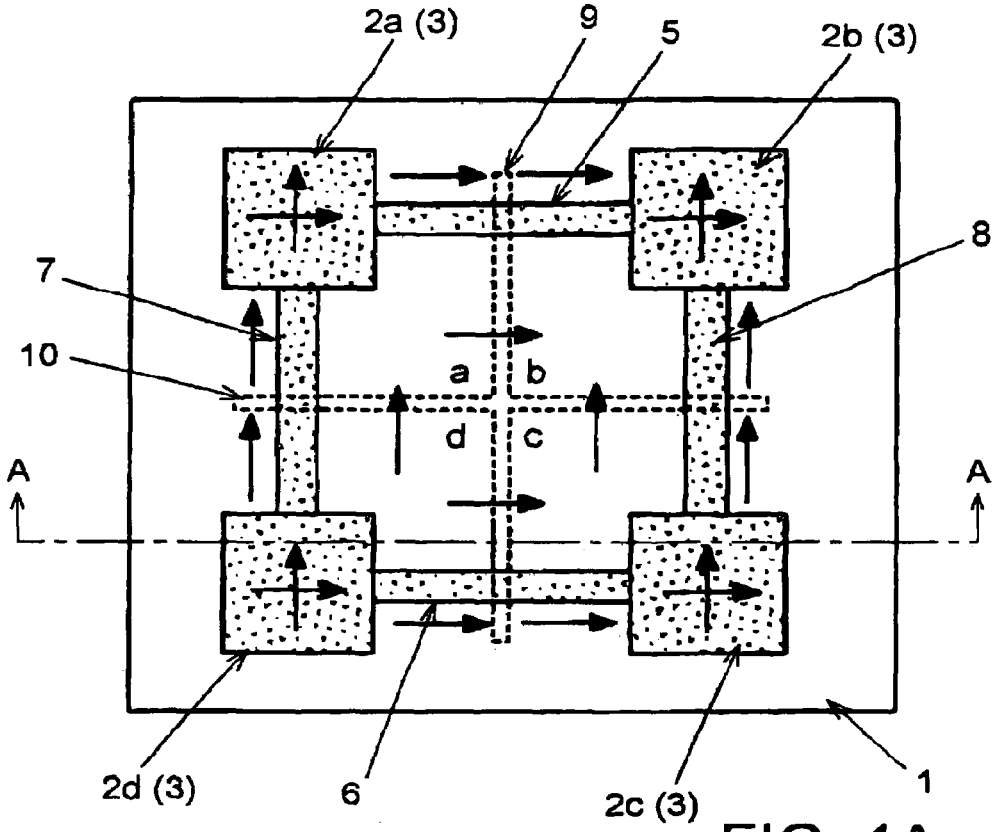
FIG. 1A (BACKGROUND ART)
FIG. 1A is a plan view of a conventional planar array antenna.
Figure 1B:
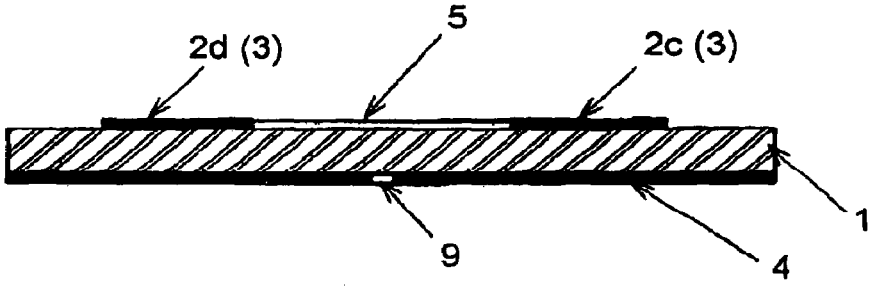
FIG. 1B (BACKGROUND ART)
FIG. 1B is a cross sectional view taken along the line A—A of FIG. 1A.
Figure 2A:
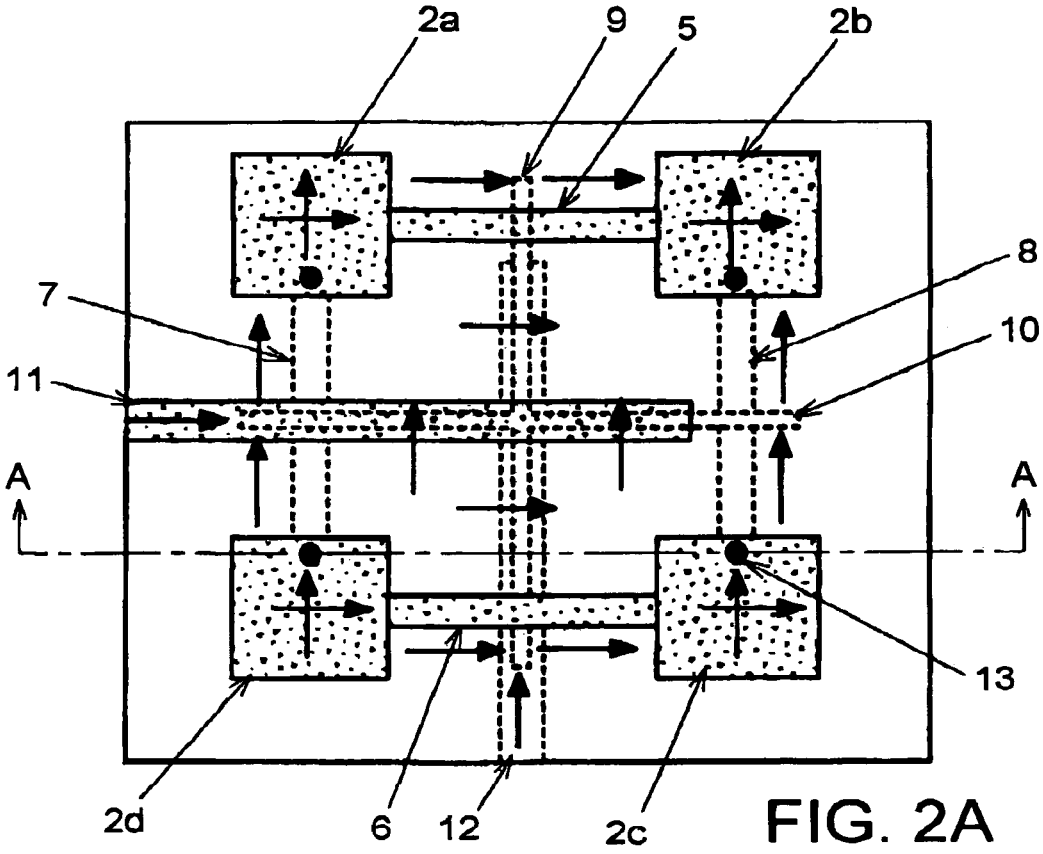
FIG. 2A is a plan view illustrating a planar array antenna according to a first embodiment of the present invention.
Figure 2B:
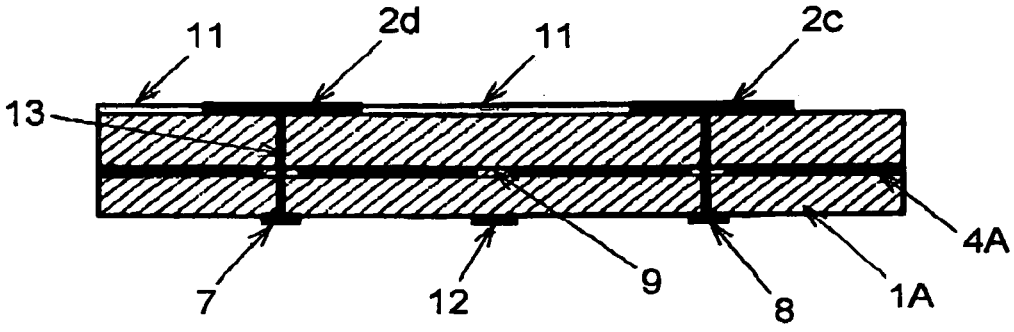
FIG. 2B is a cross sectional view taken along the line A—A of FIG. 2A.

FIGS. 2A and 2B illustrate a planar array antenna according to a first embodiment of the present invention. In FIGS. 2A and 2B, the same reference numerals will be attached to the same constituent components as those in FIGS. 1A and 1B, and the repeated description thereof will be omitted.

The planar array antenna of the first embodiment illustrated in FIGS. 2A and 2B is configured by using multi-layer substrate 1A having intermediate layer conductor 4A. Multi-layer substrate 1A is laminated in two layers with a dielectric substrate, and intermediate layer conductor 4A is formed across an almost entire plane of the laminated face of the two dielectric substrates. Intermediate layer conductor 4A is made of a metal foil and functions as a ground conductor in microstrip lines. A first principal surface of multi-layer substrate 1A, similarly to those shown in FIGS. 1A and 1B, is disposed with four antenna elements 2*a* to 2*d* of a microstrip line type corresponding to the corners of a geometrically regular square shape. The antenna elements are fed by first and second feeding systems from two mutually orthogonal directions of the upper and lower (vertical) directions in the figure and the left and right (horizontal) directions in the figure. Here, each of antenna elements 2*a* to 2*d* is formed in the shape of a regular square.

A first feeding system comprises first slot line 9 extending in the vertical direction, first and second microstrip lines 5 and 6, and fifth microstrip line 11. First and second microstrip lines 5 and 6 are orthogonal to and traverse both end sides, that is, vertical end sides in the figure, of first slot line 9 at the center regions of first and second microstrip lines 5 and 6. First and second microstrip lines 5 and 6 extend along the upper and lower sides of the planar array antenna in the horizontal direction in the figure. A second feeding system comprises second slot line 10 extending in the horizontal direction, third and fourth microstrip lines 7 and 8, and sixth micro strip line 12. Third and fourth microstrip lines 7 and 8 are orthogonal to and traverse both end sides, that is, left and right sides in the figure, of second slot line 10 at the center regions of third and fourth microstrip lines 7 and 8. Third and fourth microstrip lines 7 and 8 extend along the left and right sides of the planer array antenna in the vertical direction in the figure.

First slot line 9 and second slot line 10 are provided in intermediate layer conductor 4A of multi-layer substrate 1A, and as described above, each of the centers is orthogonal to each other. The intersection of first and second slot lines 9 and 10 is located at the center region of a geometrically regular square shape, on the apex of which each of antenna elements 2*a* to 2*d* is disposed. Both ends of each slot line stick out beyond the position for coupling antenna elements 2*a* to 2*d*, respectively.

First and second microstrip lines 5 and 6, and fifth microstrip line 11 are provided on one principal surface of the multi-layer substrate 1A. First microstrip line 5 electrically directly connects antenna elements 2*a* and 2*b* provided in the upper side left and right in the figure, and second microstrip line 6 electrically directly connects antenna elements 2*d* and 2*c* provided in the lower side left and right in the figure. Fifth microstrip line 11 passes between antenna elements 2*a* and 2*d* from a feeding end provided at the left end of multi-layer substrate 1A, and extends till the region of the center of first slot line 9, and becomes orthogonal to first slot line 9 thereby traversing first slot line 9.

Third and fourth microstrip lines 7 and 8, and sixth microstrip line 12 are provided on the other principal surface of multi-layer substrate 1A. Third microstrip line 7 is electrically directly connected to antenna elements 2*a* and 2*d* provided in the vertical direction of the left side in the figure through via holes 13, and fourth microstrip line 8 is electrically directly connected to antenna elements 2*b* and 2*c* provided in the vertical direction of the right side in the figure through via holes 13. Via holes 13 are formed in multi-layer substrate 1A. Sixth microstrip 12 passes between antenna elements 2*c* and 2*d* from the feeding end provided at the lower end of multi-layer 1A, and extends till the region of the center of second slot line 10, and becomes orthogonal to second slot line 10 thereby traversing second slot line 10.

If the configuration is like this, by first feeding system, the high frequency supplied from the left end of multi-layer substrate 1A is electromagnetically coupled to first slot line 9 extending in the vertical direction at its center through fifth microstrip line 11, and is branched in-phase to both end sides (upper and lower ends) from the center of first slot line 9, and similarly to the aforementioned, is electromagnetically coupled at each center of first and second microstrip lines 5 and 6 which extend in the horizontal direction. The high frequency then branches off in reverse phase from each center of first and second microstrip lines 5 and 6, and feeds each of antenna elements 2*a* to 2*d* in-phase in the horizontal direction. Consequently, the high frequency radio wave can be radiated and transmitted, for example, as a horizontal polarization.

Similarly, by the second feeding system, the high frequency supplied from the lower end of multi-layer substrate 1A is electromagnetically coupled to horizontal second slot line 10 at its center through sixth microstrip line 12, and is branched in-phase to both ends (left and right ends) from the center of second slot line 10, and similarly to the aforementioned, is electromagnetically coupled at each center of third and fourth microstrip lines 7 and 8 which extend in the vertical direction. The high frequency then branches in reverse phase from each center of third and fourth microstrip lines 7 and 8, and feeds each of antenna elements 2*a* to 2*d* in-phase in the vertical direction. Consequently, high frequency radio wave can be radiated and transmitted as a vertical polarization.

The planar array antenna can also receive the horizontal and vertical polarizations by reverse action.

In this example, four pieces of antenna elements 2*a* to 2*d* are used for making an array, and a planar array antenna, which is shareable with transmission and reception of the horizontal and vertical polarization, can be obtained by the first and second feeding systems. The first and second feeding systems are based on the mutually orthogonal first and second slot lines, which are provided on the laminated face, that is, in intermediate layer conductor 4A, and are further provided with the first to fourth microstrip lines, which are electromagnetically coupled to the both end sides of these slot lines, and fifth and sixth microstrip lines, which are electromagnetically coupled to the center region of these slot lines. Hence, the wiring in each feeding system can be simplified.

First, second and fifth microstrip lines 5, 6 and 11 of the first feeding system are formed in one principal surface of multi-layer substrate 1A, and third, fourth and sixth microstrip lines 7, 8 and 12 of the second feeding systems are formed in the other principal surface, and third and fourth microstrip lines 7 and 8 on the other principal surface are connected to antenna elements 2*a* to 2*d* through via holes 13. The first and second feeding systems are thus electrically independent from each other, and do not interfere each other, and can definitely perform the feeding to each of antenna elements 2*a* to 2*d*.

Since first and second slot lines 9 and 10 are fed by fifth and sixth microstrip lines 11 and 12 from the left end and the lower end of multi-layer substrate 1A, in this planar array antenna, there is no need to feed the substrate surface from the vertical direction by using the functional device as conventionally. In this planar array antenna, in addition to simplification of the wiring of the first and second feeding systems, surfaceness of the planar array antenna can be further promoted.

Figure 3:
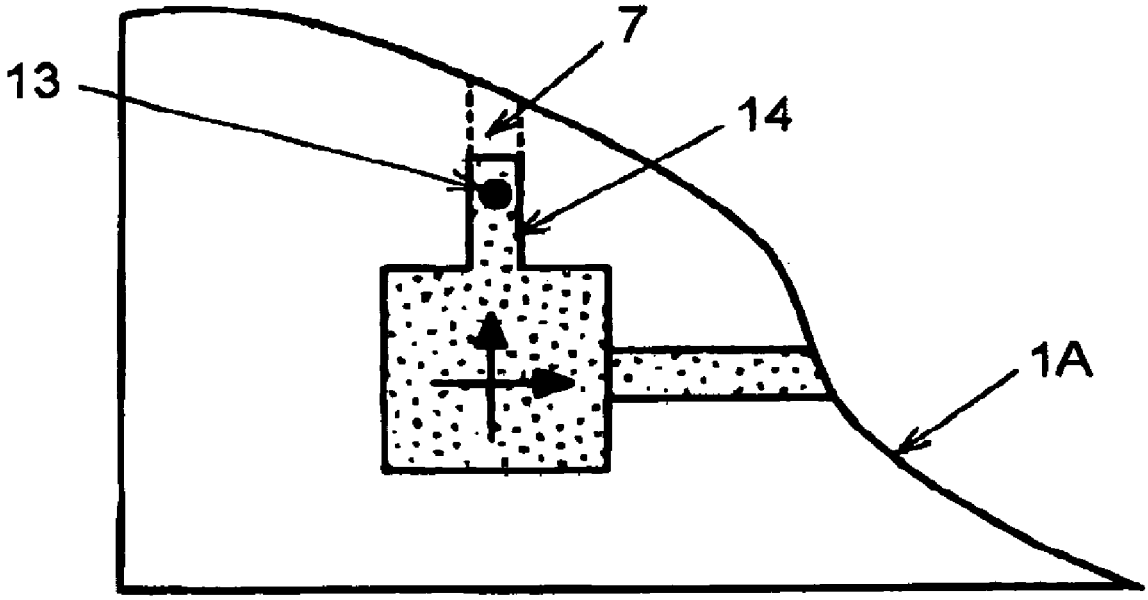
FIG. 3 is a partial plan view illustrating another example of the planar array antenna of the first embodiment.

It should be noted that, in the first embodiment, via holes 13 which connect each of both ends of third and fourth microstrip lines 7 and 8 on the other principal surface in multi-layer substrate 1A and antenna elements 2*a* to 2*d* on one principal surface may be configured, for example, as shown in FIG. 3. That is, protrusion 14 overlaid on third and fourth microstrip lines 7 and 8, respectively, are provided in each of antenna elements 2*a* to 2*d*, and via holes 13 may be formed on the positions of these protrusions 4. In this case, since there is no via hole 13 formed within antenna elements 2*a* to 2*d*, resonance characteristic of the antenna element can be satisfactorily maintained. In case via holes 13 are used with antenna elements 2*a* to 2*d* of a microstrip line type, in the following embodiments also, such protrusions 14 are provided, and the via holes can be provided in these protrusions 14.

Figure 4A:
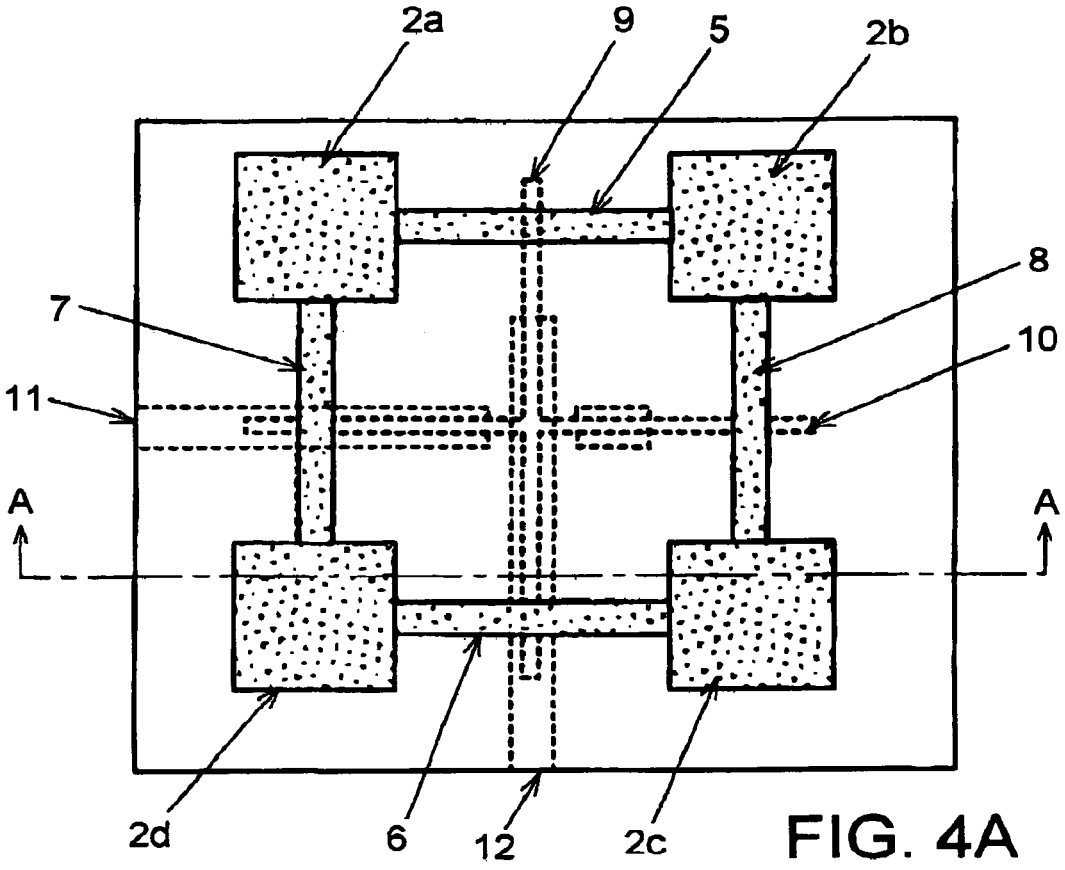
FIG. 4A is a plan view Illustrating a planar array antenna according to a second embodiment of the present invention.
Figure 4B:
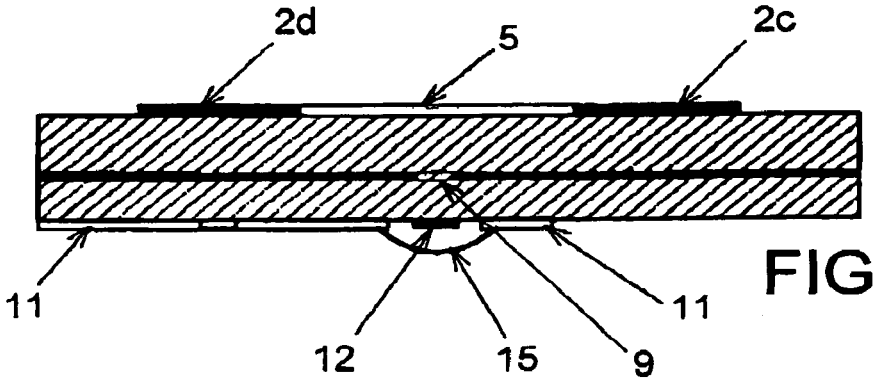
FIG. 4B is a cross sectional view taken along the line A—A of FIG. 4A.

FIGS. 4A and 4B illustrate a planar array antenna according to a second embodiment of the present invention. This planar array antenna uses multi-layer substrate 1A having intermediate layer conductor 4A, and a basic configuration in which mutually orthogonal first and second slot lines 9 and 10 are provided in intermediate layer conductor 4A is the same as the first embodiment. However, this example does not use via hole, in which antenna elements 2*a* to 2*d* are fed from two directions which are orthogonal to each other.

Four corners of one principal surface of multi-layer substrate 1A are formed with antenna elements 2*a* to 2*d*. These antenna elements are electrically connected by first to fourth microstrip lines 5 to 8 formed in one principal surface. First and second microstrip lines 5 and 6 are orthogonal to first slot line 9 at the upper and lower end sides of first slot line 9 extending in the vertical direction so as to be electromagnetically coupled. Third and fourth microstrip lines 7 and 8 are orthogonal to second slot line 10 at the left and right end sides of second slot line 10 extending in the horizontal direction so as to be electromagnetically coupled.

The other principal surface of multi-layer substrate 1A is provided with fifth and sixth microstrip lines 11 and 12, which extend from the left end and lower end to the horizontal and vertical directions in the figure, respectively. Fifth microstrip line 11 passes between antenna elements 2*a* and 2*d*, and at the position of a median point of first slot line 9, extends further by air bridge using conducting wire 15, and becomes orthogonal to first slot line 9. Sixth microstrip line 12 extends between antenna elements 2*c* and 2*d*, and passes between both ends of the air bridge of fifth microstrip line 11, and becomes orthogonal to second slot line 10 at the position of a median point of second slot line.

If the configuration is like this, similarly to the case of the first embodiment, by a first feeding system comprising first slot line 9, first and second microstrip lines 5 and 6, and fifth microstrip line 11, high frequency is fed to each of antenna elements 2*a* to 2*d* in the horizontal direction in the figure. Similarly, by a second feeding system comprising second slot line 10, third and fourth microstrip lines 7 and 8, and sixth microstrip line 12, high frequency is fed to each of antenna elements 2*a* to 2*d* in the vertical direction in the figure.

In this case, since fifth microstrip line 11 is connected by air bridges using conducting wire 15, the first and second feeding systems are electrically independent from each other, and the short-circuit between both systems can be prevented. Consequently, in this planar array antenna, horizontal and vertical polarizations can be independently transmitted and received, and moreover, the wiring thereof can be simplified. Since the feeding is made from the left end and the lower end of multi-layer substrate 1A by fifth and sixth microstrip lines 11 and 12, here also, surfaceness of the antenna can be achieved.

Figure 5A:
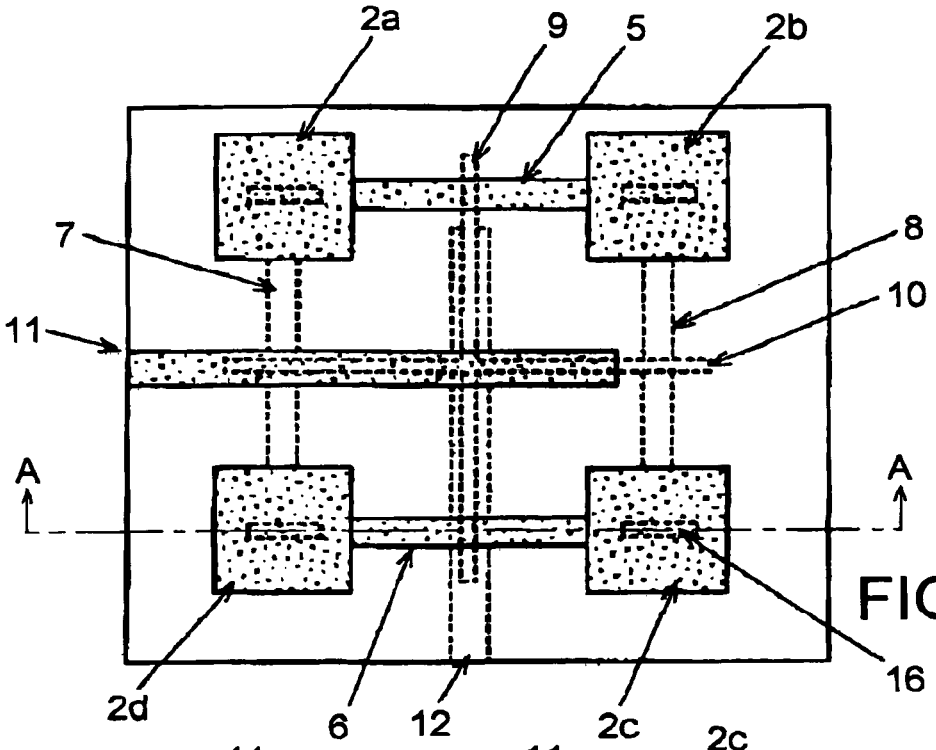
FIG. 5A is a plan view illustrating a planar array antenna according to a third embodiment of the present invention.
Figure 5B:
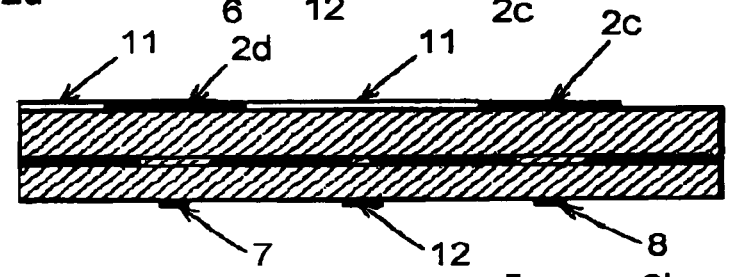
FIG. 5B is a cross sectional view taken along the line A—A of FIG. 5A.
Figure 5C:
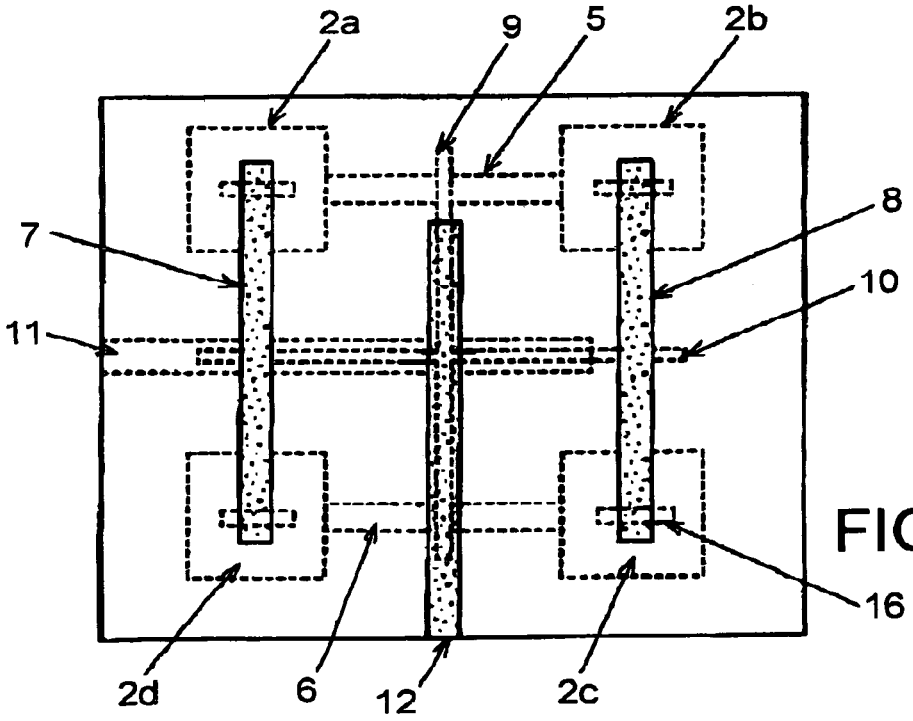
FIG. 5C is a rear surface view of the planar array antenna illustrated in FIG. 5A.

FIGS. 5A to 5C illustrate a planer array antenna according to a third embodiment of the present invention. FIG. 5C is equivalent to a view seen through from above the planar array antenna Illustrated in FIG. 5A, and depicts the components at the rear surface side by a solid line.

In this planar array antenna, a basic configuration in which a feeding system is comprised of mutually orthogonal first and second slot lines 9 and 10 which are provided in intermediate layer conductor 4A of the laminated face of multi-layer substrate 1A is the same as the above described embodiments. In the third embodiment, without using via holes and air bridges by conducting wires, the feeding to each of antenna elements 2*a* to 2*d* from two orthogonal directions, that is, horizontal and vertical directions, is made possible.

Four corners of one principal surface in multi-layer substrate 1A is formed with four antenna elements 2*a* to 2*d* of a microstrip line type, and openings 16 are formed at a corresponding position below the center of each of antenna elements 2*a* to 2*d*, respectively, in intermediate layer conductor 4A. Antenna elements 2*a* and 2*b* are electrically directly connected by first microstrip line 5 provided on one principal surface of multi-layer substrate 1A, and antenna elements 2*c* and 2*d* are electrically directly connected by second microstrip line 6 provided on one principal surface of multi-layer substrate 1A. Third microstrip line 7 provided on the other principal surface of multi-layer substrate 1A is electromagnetically coupled to antenna elements 2*a* and 2*d* through openings 16. Similarly, fourth microstrip line 8 provided on the other principal surface of multi-layer substrate 1A is electromagnetically coupled to antenna elements 2*b* and 2*c* through openings 16.

First slot line 9 is electromagnetically coupled with fifth microstrip line 11 provided on one principal surface of multi-layer substrate 1A so as to be fed. Similarly, second slot line 10 is electromagnetically coupled with fifth microstrip line 12 provided on one principal surface of multi-layer substrate 1A so as to be fed. In this manner, first and second feeding systems are formed in which, similarly as aforementioned, high frequency is applied to each of antenna elements 2*a* to 2*d*, respectively from horizontal and vertical directions.

If the configuration is like this, since third and fourth microstrip lines 7 and 8 provided on the other principal surface of substrate 1A and antenna elements 2*a* to 2*d* are electromagnetically coupled by openings 16 provided on the laminated face, without using via holes 13 and air bridges, horizontal and vertical polarizations can be transmitted and received. Similarly to the aforementioned embodiments, surfaceness of the antenna can be promoted.

Figure 6A:
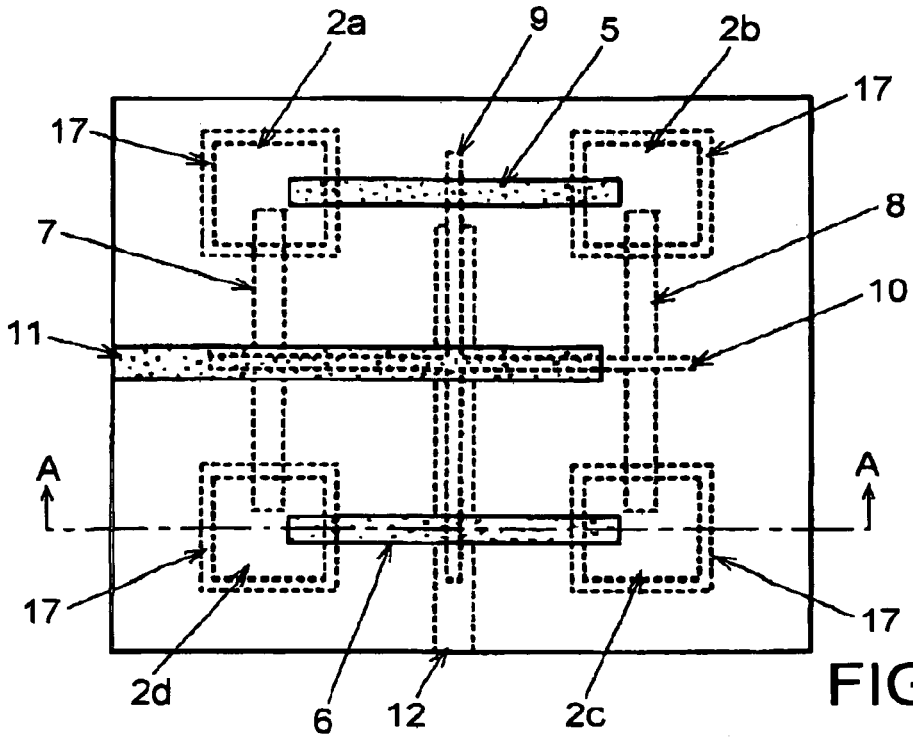
FIG. 6A is a plan view Illustrating a planar array antenna according to a fourth embodiment of the present invention.
Figure 6B:
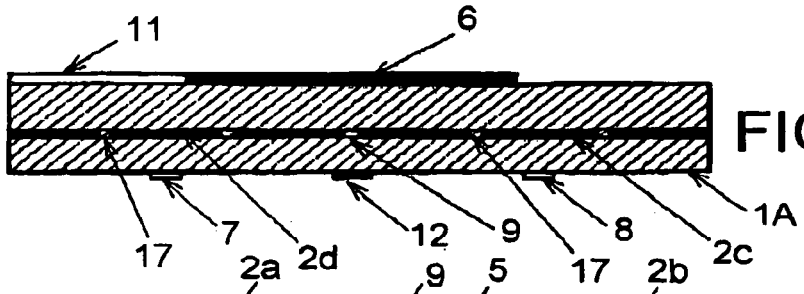
FIG. 6B is a cross sectional view taken along the line A—A of FIG. 6A.
Figure 6C:
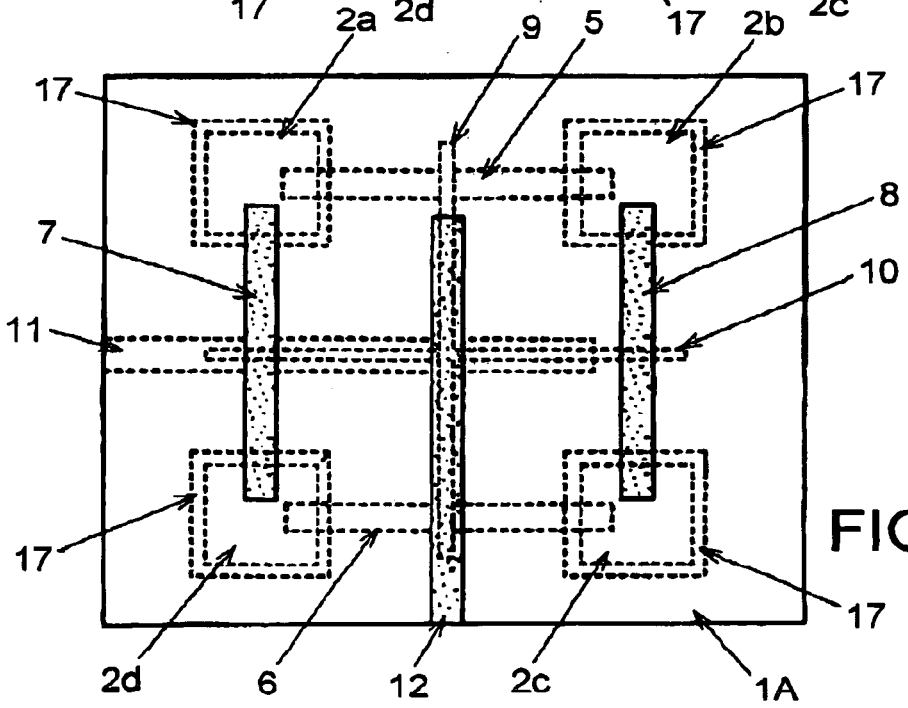
FIG. 6C is a rear surface view of the planar array antenna illustrated in FIG. 6A.

FIGS. 6A to 6C illustrate a planar array antenna according to a fourth embodiment of the present invention. FIG. 6C is equivalent to a view seen through from above the planar array antenna shown in FIG. 6A, and depicts the components of the rear surface side by a solid line.

The planar array antenna according to the fourth embodiment is different from the third embodiment in that, while the feeding is made without using via holes and air bridges as those of the third embodiment, as an antenna element, instead of a microstrip line type, a slot line type is used.

Intermediate layer conductor 4A of multi-layer substrate 1A is provided with four annular aperture lines 17, which constitute antenna elements 2*a* to 2*d* of a slot line type. Here also, four antenna elements 2*a* to 2*d* are disposed at the four corners of a geometrically regular square shape. Each of aperture lines 17 is formed in a shape along the four sides of the regular square shape. Intermediate layer conductor 4A is, similarly to the aforementioned, provided with mutually orthogonal first and second slot lines 9 and 10.

One principal surface of multi-layer substrate 1A is formed with first, second, and fifth microstrip lines 5, 6, and 11 extending in the horizontal direction in the figure, and forms a first feeding system together with first slot line 9 which is provided on the laminated face of multi-layer substrate 1A and extends in the vertical direction. That is, first microstrip line 5 is electromagnetically coupled to antenna elements 2*a* and 2*b* of a slot line type at both ends thereof, and second microstrip line 6 is electromagnetically coupled to antenna elements 2*c* and 2*d* of a slot line type at both ends thereof. Microstrip lines 5 and 6 are electromagnetically coupled to the upper and lower ends of first slot line 9 at each of median points thereof. Fifth microstrip line 11 passes between antenna elements 2*a* and 2*d*, and extends till the position of the median point of first slot line 9, and is electromagnetically coupled to first slot line 9.

The other principal surface of multi-layer substrate 1A is formed with third, fourth and sixth microstrip lines 7, 8, and 12 extending in the vertical direction in the figure, and forms a second feeding system together with second slot line 10 which is provided in the laminated face of multi-layer substrate 1A and extends in the horizontal direction. Third microstrip line 7 is electromagnetically coupled to antenna elements 2*a* and 2*d* of a slot line type at both ends thereof. Fourth microstrip line 8 is electromagnetically coupled to antenna elements 2*b* and 2*c* of a slot line type at both ends thereof. Microstrip lines 7 and 8 are electromagnetically coupled to the left and right ends of second slot line 10 at each of median points thereof. Sixth microstrip line 12 passes between antenna elements 2*c* and 2*d*, and extends till the median point of second slot line 10, and is electromagnetically coupled to second slot line 10.

If the configuration is like this, by first slot line 9 provided on the laminated face of multi-layer substrate 1A and first, second, and third microstrip lines 5, 6, and 11 provided on one principal surface, high frequency from the horizontal direction can be fed to each of antenna elements 2*a* to 2*d*. Similarly, by second slot line 10 and fourth, fifth, and twelfth microstrip lines 7, 8, and 12 provided on the other principal surface, high frequency from the vertical direction can be fed to each of antenna elements 2*a* to 2*d*. Consequently, in this case also, any of horizontal and vertical polarizations can be transmitted and received. Similarly to the third embodiment, without using via holes and air bridges, the wiring can be simplified, and surfaceness of the antenna can be promoted.

In the aforementioned first to fourth embodiments, while the antenna elements are provided in the shape of a regular square, they may be provided in a circular shape.

Figure 7:
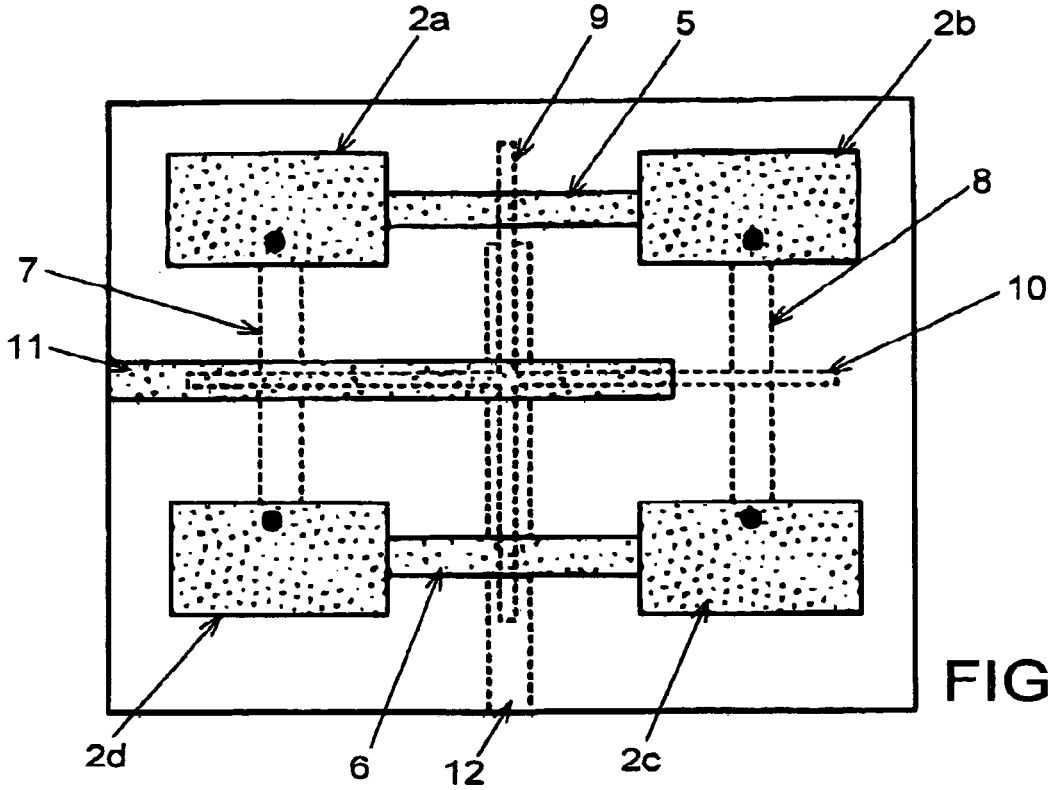
FIG. 7 is a plan view illustrating a planar array antenna according to a fifth embodiment of the present invention.

FIG. 7 illustrates a planar array antenna of a fifth embodiment of the present invention. In the aforementioned first to fourth embodiments, while a four-element planar array antenna capable of transmitting and receiving any of mutually orthogonal horizontal and vertical polarizations are illustrated, in this fifth embodiment, a two-frequency sharing planar array antenna which transmits and receives high frequencies of two different frequencies will be described.

While the array antenna illustrated in FIG. 7 is the same as that of the first embodiment, it is different in that the shape of the antenna element is rectangular. That is, each of antenna elements 2*a* to 2*d* of a microstrip line type is different in length in the horizontal direction in the figure and the vertical direction in the figure. Here, the rectangular shape is such that the horizontal direction is longer than the vertical direction. Hence, because a resonance frequency f1 in the horizontal direction and a resonance frequency f2 in the vertical direction are different (f1<f2), a four-element two-frequency-sharing planar array antenna can be obtained. In this case, the component of the resonance frequency f1 in the horizontal direction becomes a horizontal polarization, and the component of the resonance frequency f2 in the vertical direction becomes a vertical polarization. It should be noted that, while an example is shown here in correspondence with the first embodiment using via holes 13, it is, for example, the same in the case of antenna elements 2*a* to 2*d* of a slot line type. Further, in the second and third embodiments, by using rectangular antenna elements, a two-frequency sharing antenna can be configured. The shape of antenna elements is not limited to rectangle, and for example, it may be oval and the like.

Figure 8:
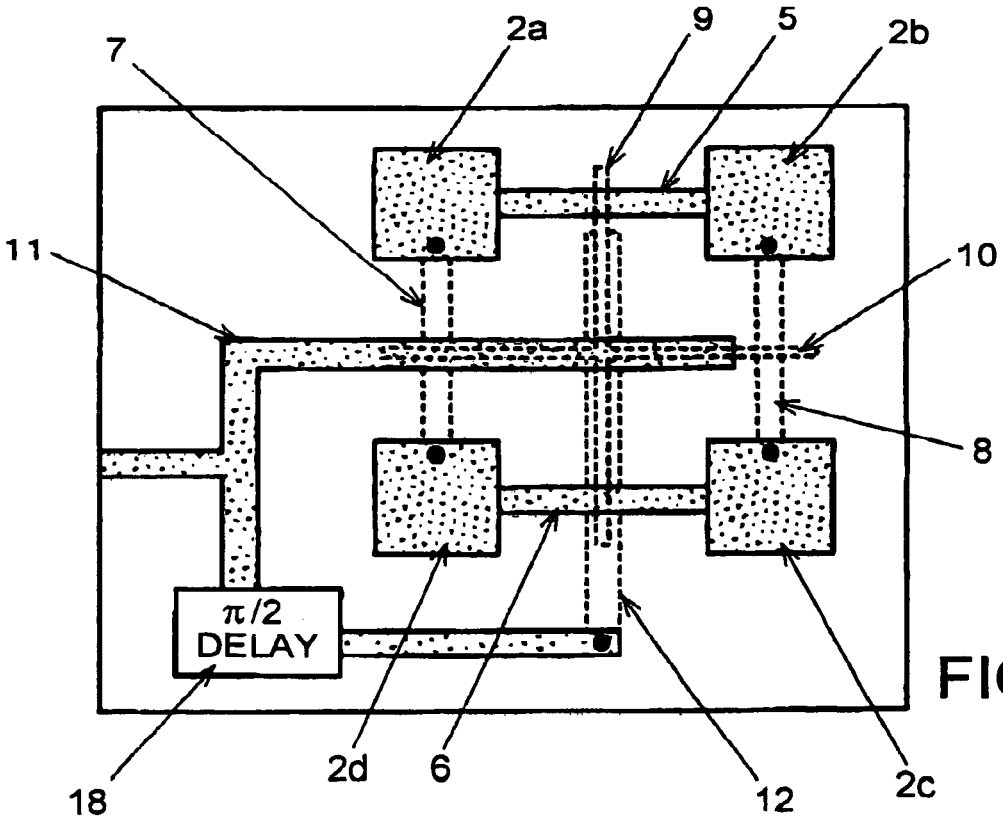
FIG. 8 is a plan view illustrating a planar array antenna according to a sixth embodiment of the present invention.

FIG. 8 illustrates a planar array antenna according to a sixth embodiment of the present invention. In the aforementioned first to fifth embodiments, while the planar array antenna that transmits and receives a linear polarization has been shown, in this sixth embodiment, the planar array antenna that transmits and receives a circular polarization will be described. In this planar array antenna, which is different from the planar array antenna of the aforementioned first embodiment, the feeding is made through delay circuit 17 which takes a phase difference between both first and second feeding systems as $\pi/2$, the first feeding system being for a horizontal polarization and the second feeding system being for a vertical polarization.

Fifth microstrip line 11 of the first feeding system for the horizontal polarization and sixth microstrip line 12 of the second feeding system for the vertical polarization are commonly connected. For example, by via hole 13, sixth microstrip line 12 of the other principal surface is led to one principal surface side to form a common connection with fifth microstrip line 11. A feeding end connecting to the common connection is provided on one principal surface. Delay circuit 18 can adapt a configuration in which a wavelength corresponding to antenna frequency is taken as λ, and for example, the line length of sixth microstrip line 12 is made longer than fifth microstrip line 11 by λ/4, and a phase difference only by π/2 is generated.

By so doing, since the high frequency component of the second feeding system of the vertical polarization is delayed by π/2 than the high frequency component of the first feeding system of the horizontal polarization and is fed to each of antenna elements 2*a* to 2*d*, a circular polarization can be transmitted and received. Since the circular polarization illustrated in the figure has the horizontal polarization advanced by π/2 than the vertical polarization, it becomes a dextro-circular polarization. Naturally, by reserving the phase different, a levo-circular polarization can be generated.

In the second to fourth embodiments also, by using the aforementioned delay circuit, the planar array antenna that transmits and receives the circular polarization can be configured. It should be noted that, as the delay circuit, in addition to utilization of that having different line length, for example, a surface acoustic wave (SAW) device may be used.

Figure 9:
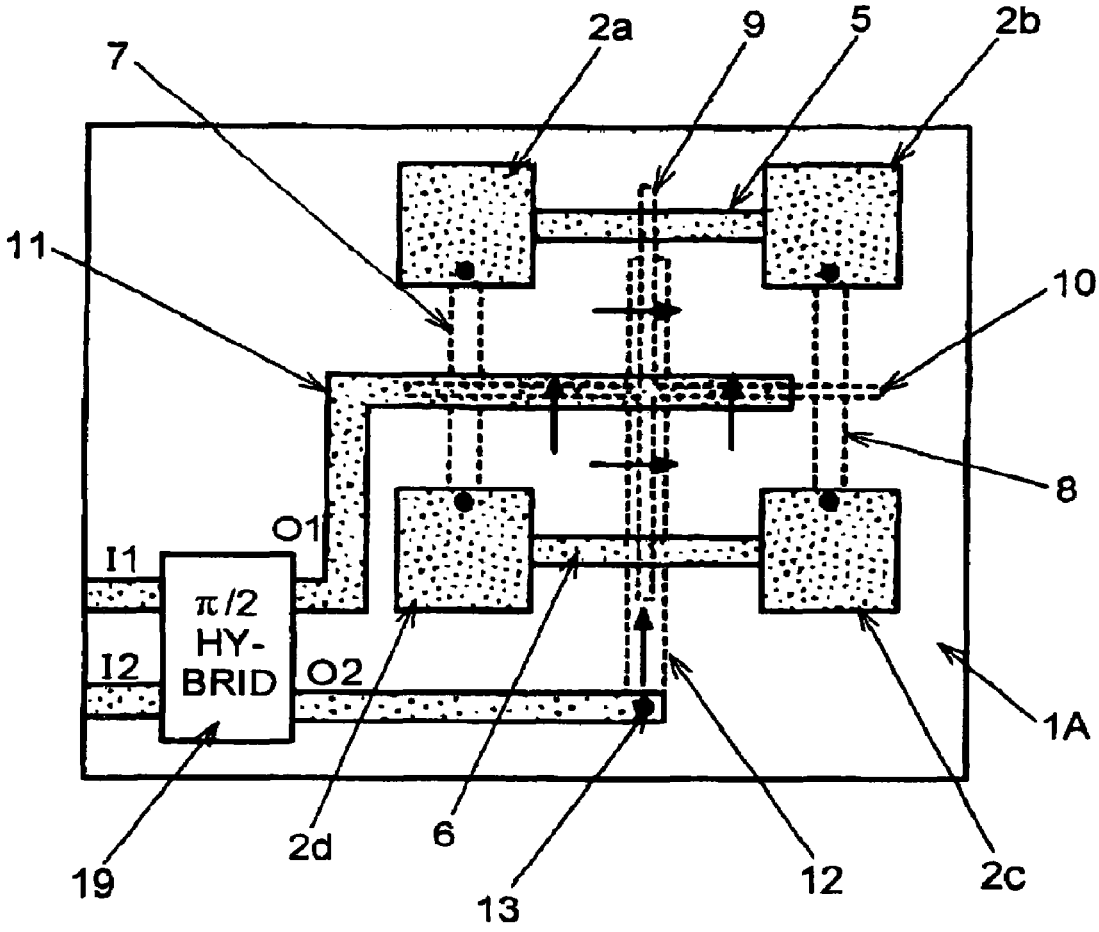
FIG. 9 is a plan view illustrating a planar array antenna according to a seventh embodiment of the present invention.

FIG. 9 illustrates a planar array antenna according to a seventh embodiment of the present invention. While this planar array antenna transmits and receives a circular polarization similarly to the antenna of the sixth embodiment, here the antenna of a configuration capable of simultaneously sharing the levo-circular polarization and the dextro-circular polarization will be described.

The planar array antenna illustrated in FIG. 9 is configured such that, in the planar array antenna of the first embodiment, between a feeding end of fifth microstrip line 11 of a first feeding system for horizontal polarization and a feeding end of sixth microstrip line 12 of a second feeding system for vertical polarization, a power distributor/coupler comprising, for example, a π/2 hybrid circuit 19 having two input ports (I1 and I2) and two output ports (O1 and O2) is connected in the planar array antenna, since high frequency components from one input port I1 and the other input port I2 in π/2 hybrid circuit have a phase difference of π/2 between two output ports O1 and O2, any of the circular polarizations which are taken as dextro and levo can be simultaneously transmitted and received. It should be noted that, while the power distributor/coupler is taken as π/2 hybrid circuit, as its representative, a λ/4 distributed-coupling type hybrid circuit, a branch line hybrid circuit, and the like can be cited.

Figure 10:
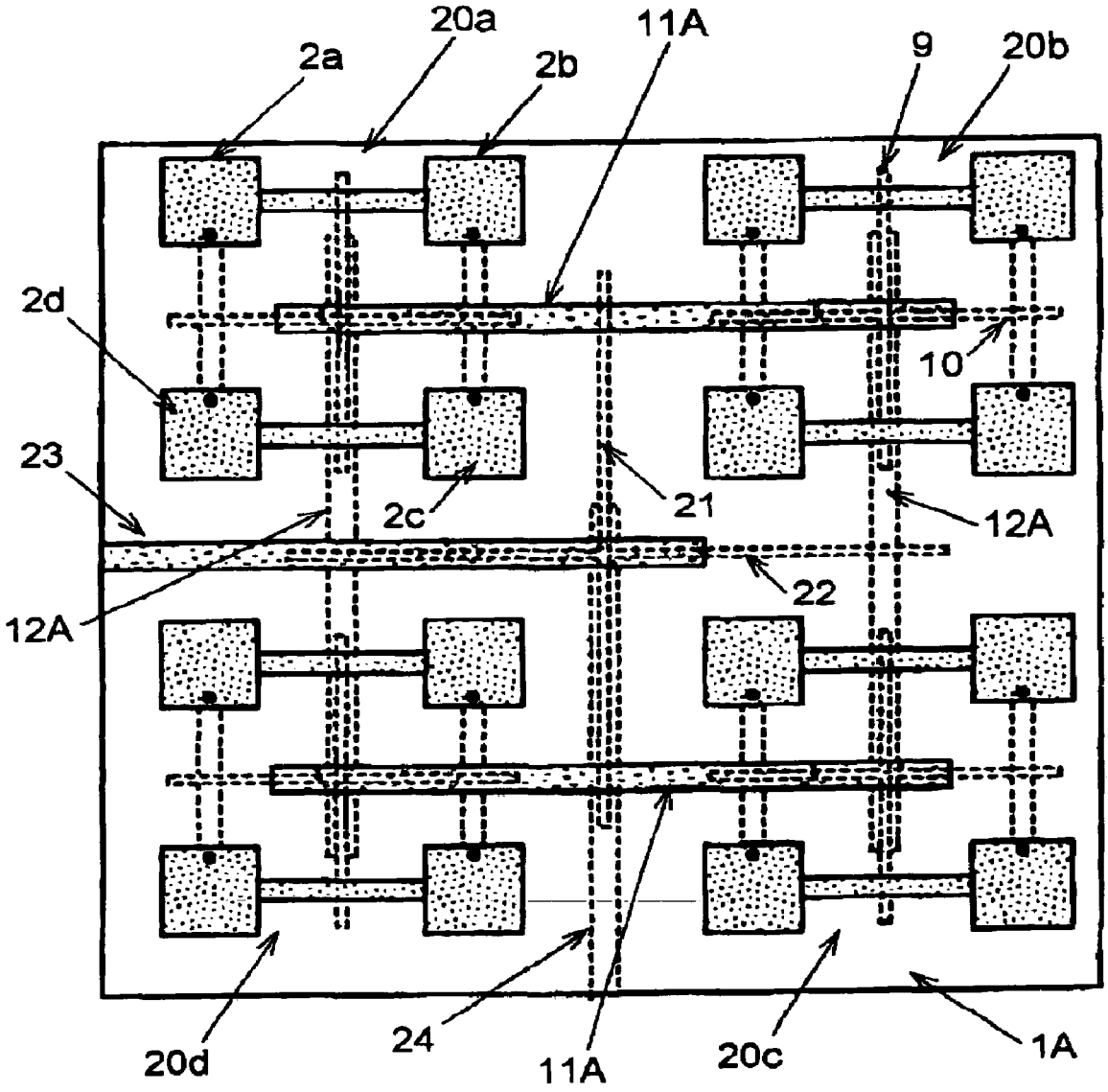
FIG. 10 is a plan view illustrating a planar array antenna according to an eighth embodiment of the present invention.

FIG. 10 illustrates a planar array antenna according to an eighth embodiment of the present invention. In this embodiment, an example will be described, in which the four-element planar array antennas of each of the aforementioned embodiments are assembled in four units, thereby configuring a 16-element planar array antenna.

The planar array antenna illustrated in FIG. 10 takes the four-element planar array antenna of the first embodiment as an one unit, and by using the same multi-layer substrate, disposes first to fourth units 20*a* to 20*d* in the vertical and horizontal directions in a matrix pattern so as to be made into an array, thereby configuring the 16-element array antenna. Here, first and second units 20*a* and 20*b* are disposed in the upper left and right in the figure of multi-layer substrate 1A, and third and fourth units 20*c* and 20*d* are disposed in the lower right and left in the figure. Each of fifth microstrip lines 11 of first and second units 20*a* and 20*b* in one principal surface of multi-layer substrate 1A is commonly connected so as to make the lines as first common microstrip line 11A. Similarly, each of fifth microstrip lines 11 of third and fourth units 20*c* and 20*d* is commonly connected so as to make the lines also as first common microstrip line 11A. Sixth microstrip lines 12 of first and fourth units 20*a* and 20*d* are commonly connected so as to make the lines as second common microstrip line 12A, and sixth microstrip lines 12 of second and third units 20*b* and 20*c* are commonly connected so as to make the lines also as second common microstrip line 12A.

The laminated face of multi-layer substrate 1A is formed with third slot line 21 in the vertical direction and fourth slot line 22 in the horizontal direction where a cross-shaped intersection is positioned in the center region. Third slot line 21 traverses upper and lower first common microstrip lines 11A at both ends thereof so as to be electromagnetically coupled. Fourth slot line 22 traverses left and right second common microstrip lines 12A at both ends thereof so as to be electromagnetically coupled.

One principal surface of multi-layer substrate 1A is formed with seventh microstrip line 23 extending in the horizontal direction, which traverses third slot line 21 at the center of third slot line 21 so as to be electromagnetically coupled to third slot line 21. The left end of seventh microstrip line 23 is taken as a feeding end. The other principal surface of multi-layer substrate 1A is formed with eighth microstrip line 24 extending in the vertical direction, which traverses fourth slot line 22 at the center of fourth slot line 22 so as to be electromagnetically coupled to fourth slot line 22. This lower end of eighth microstrip line 24 is taken as a feeding end.

If the configuration is like this, for example, the high frequency from the feeding end (left end in the figure) of seventh microstrip line 23 is electromagnetically coupled to third slot line 21, and is branched in-phase to the upper and lower end sides from the median point of third slot line 21. The high frequency is then electromagnetically coupled to a pair of first common microstrip lines 11A at the upper and lower end sides of third slot line so as to be branched in reverse phase, and is electromagnetically coupled to first slot lines 9 of first to fourth unit 20*a* to 20*d*. In this manner, in-phase high frequency is fed to each of antenna elements 2*a* to 2*d*, and each of antenna elements 2*a* to 2*d* transmits a horizontal polarization. The high frequency from the feeding end (lower end in the figure) of eighth microstrip line 24 is electromagnetically coupled to fourth slot line 22, and is branched in-phase from the median point of fourth slot line 21. The high frequency is then electromagnetically coupled to a pair of second common microstrip lines 12A at the left and right end sides of fourth slot line 22, and is branched in reverse phase, and is electromagnetically coupled to second slot lines 10 of first to fourth units 20*a* to 20*d*. From each of antenna elements 2*a* to 2*d*, the vertical polarization is transmitted. In this manner, even in case four elements of antenna elements 2*a* to 2*d* are taken as one unit and four units are provided, thereby using a total of 16 elements, similarly to the aforementioned, the planar array antenna sharing a horizontal polarization and a vertical polarization can be obtained.

While the case has been described here in which the four-element planar array antenna of the first embodiment is taken as one unit and four units are provided, a 16-element array antenna can be configured in the case of the second to seventh embodiments also. Further, if these four units are taken as one unit and such unit comprising 16 elements is disposed four pieces in the vertical and horizontal directions, the planar array antenna of 64 elements in total can be obtained.

In brief, with n taken as a positive integer, if $4^n$ pieces of antenna elements are taken as one unit, and are disposed in the vertical and horizontal directions so as to configure an antenna, the planar array antenna of $4^{(n-1)}$ pieces of elements in total can be obtained. Further, by elaborating the feeding system, one unit is disposed in the vertical or horizontal direction, thereby making an antenna of eight elements or 32 elements. That is, according to the present invention, based on a unit comprising four pieces of elements, a multi-element planar array antenna having one or plural pieces of such a unit can be easily configured.

What is claimed is:

1. A planar array antenna, comprising:

a multi-layer substrate having an intermediate layer conductor in a laminated face;

first and second slot lines formed in said intermediate layer conductor, and intersecting each other;

first and second microstrip lines formed on said multi-layer substrate, and traversing said first slot line, respectively, at a position corresponding to both end sides of said first slot line;

third and fourth microstrip lines formed on said multi-layer substrate, and traversing said second slot line, respectively, at a position corresponding to both end sides of said second slot line;

a first antenna element coupling to one end of said first microstrip line and one end of said third microstrip line;

a second antenna element coupling to the other end of said first microstrip line and one end of said fourth microstrip line;

a third antenna element coupling to one end of said second microstrip line and the other end of said fourth microstrip line;

a fourth antenna element coupling to the other end of said second microstrip line and the other end of said third microstrip line;

a fifth microstrip line provided on said multi-layer substrate, a top end side of said fifth microstrip line traversing said first slot line in a center region of said first slot line so as to be electromagnetically coupled to said first slot line; and a sixth microstrip line provided on said multi-layer substrate, a top end side of sixth microstrip line traversing said second slot line in a center region of said second slot line so as to be electromagnetically coupled to said second slot line;

wherein each of said first to fourth antenna elements is an antenna element excitable in two directions.

2. The planar array antenna according to claim 1, wherein said first to fourth antenna elements are disposed on a geometrically square apex, respectively.

3. The planar array antenna according to claim 2, wherein said first to fourth antenna elements are an antenna element of a microstrip line type provided on a first principal surface of said multi-layer substrate, said first and second microstrip lines are provided on said first principal surface, and are directly connected to said antenna elements, said third and fourth microstrip lines are provided on a second principal surface of said multi-layer substrate, said fifth microstrip line is provided on said first principal surface, and said sixth microstrip line is provided on said second principal surface.

4. The planar array antenna according to claim 3, wherein said third and fourth microstrip lines are electrically connected to said antenna elements through via holes provided on said multi-layer substrate.

5. The planar array antenna according to claim 3, wherein said third and fourth microstrip lines are electromagnetically coupled to said antenna elements through openings provided in said intermediate layer conductor.

6. The planar array antenna according to claim 3, wherein said each antenna element is provided in a shape of a regular square or a circle, and is excitable in two directions at the same frequency, thereby sharing a horizontal polarization and a vertical polarization.

7. The planar array antenna according to claim 2, wherein said first to fourth antenna elements are an antenna element of a microstrip line type provided on a first principal surfaoe of said multi-layer substrate, said first to fourth microstrip lines are provided on said first principal surface, and are electrically connected to said antenna elements, and said fifth and sixth microstrip lines are provided on a second principal surface of said multi-layer substrate, and wherein one of said fifth and sixth microstrip lines strides over the other of said fifth and sixth microstrip lines through an air bridge using a conducting wire in a region where said first and second slot lines intersect each other.

8. The planar array antenna according to claim 7, wherein said each antenna element is provided in a shape of a regular square or a circle, and is excitable in two directions at the same frequency, thereby sharing a horizontal polarization and a vertical polarization.

9. The planar array antenna according to claim 2, wherein said first to fourth antenna elements are an antenna element of a slot line type formed in said interlayer conductor, said first and second microstrip lines are electromagnetically coupled to said antenna elements provided on a first principal surface of said multi-layer substrate, said third end fourth microstrip lines are provided on a second principal surface of said multi-layer substrate, and are electromagnetically coupled to said antenna elements, said fifth microstrip line is provided on said first principal surface, and said sixth microstrip line is provided on said second principal surface.

10. The planar array antenna according to claim 9, wherein said each antenna element is provided in a shape of a regular square or a circle, and is excitable in two directions at the same frequency, thereby sharing a horizontal polarization and a vertical polarization.

11. The planar array antenna according to claim 1, wherein said each antenna element is provided in a shape of a regular square or a circle, and is excitable in two directions at the same frequency, thereby sharing a horizontal polarization and a vertical polarization.

12. The planar array antenna according to claim 1, wherein said each antenna element is provided in a shape of a rectangle or an oval, thereby enabling to operate at plural frequencies.

13. The planar array antenna according to claim 1, further comprising a delay circuit making a phase difference between said fifth microstrip line and said sixth microstrip line as 90 degrees.

14. The planar array antenna according to claim 13, wherein said delay circuit is a power distributor/coupler having two input ports and two output ports, and high frequency components from one input port and the other input port are given a phase difference of $\pi/2$ which mutually advances and delays between said two output ports.

15. A planar array antenna, comprising:

a multi-layer substrate having an intermediate layer conductor on a laminated face; and four pieces of planar antenna units formed on said multi-layer substrate, and disposed in a matrix pattern;

wherein each planar antenna unit comprises: first and second slot lines formed in said intermediate layer conductor, and intersecting each other; first and second microstrip lines formed on said multi-layer substrate, and traversing said first slot line, respectively, at a position corresponding to both end sides of said first slot line; third and fourth microstrip lines formed on said multi-layer substrate, and traversing said second slot line, respectively, at a position corresponding to both end sides of said second slot line; a first antenna element coupling to one end of said first microstrip line and one end of said third microstrip line; a second antenna element coupling to the other end of said first microstrip line and one end of said fourth microstrip line; a third antenna element coupling to one end of said second microstrip line and the other end of said fourth microstrip line; a fourth antenna element coupling to the other end of said second microstrip line and the other end of said third microstrip line; a fifth microstrip line provided on said multi-layer substrate, a top end side of said fifth microstrip line traversing said first slot line in a center region of said first slot line so as to be electromagnetically coupled to said first slot line, and a sixth microstrip line provided on said multi-layer substrate, a top end side of said sixth microstrip line traversing said second slot line in a center region of said second slot line so as to be electromagnetically coupled to said second slot line, and wherein said fifth microstrip lines of two pieces of said planar antenna units adjacent to a first direction are commonly connected, thereby configuring a first common microstrip line, and said sixth microstrip lines of two pieces of said planar antenna units adjacent to a second direction different from said first direction are commonly connected, thereby configuring a second common microstrip line, said planar array antenna, further comprising:

third and fourth slot lines formed on said intermediate layer conductor, and mutually intersecting;

a seventh microstrip line formed on said multi-layer substrate, a top end side of said seventh microstrip line traversing said third slot line in a center region of said third slot line so as to be electromagnetically coupled to said third slot line; and an eighth microstrip line provided on said multi-layer substrate, a top end side of said eighth microstrip line traversing said fourth slot line in a center region of said fourth slot line so as to be electromagnetically coupled to said fourth slot line;

wherein said first common microstrip lines traverse said third slot line, respectively, at a position corresponding to both end sides of said third slot line, and said second common microstrip lines traverse said fourth slot line, respectively, at a position corresponding to both end sides of said fourth slot line.

* * * * *